US005940797A

United States Patent [19]

Abe

[11] Patent Number: 5,940,797

[45] Date of Patent: Aug. 17, 1999

[54] SPEECH SYNTHESIS METHOD UTILIZING AUXILIARY INFORMATION, MEDIUM RECORDED THEREON THE METHOD AND APPARATUS UTILIZING THE METHOD

[75] Inventor: Masanobu Abe, Yokohama, Japan

[73] Assignee: Nippon Telegraph and Telephone Corporation, Tokyo, Japan

[21] Appl. No.: 08/933,140

[22] Filed: Sep. 18, 1997

[30] Foreign Application Priority Data

Sep. 24, 1996 [JP] Japan ..... 8-251707
Sep. 4, 1997 [JP] Japan ..... 9-239775

[51] Int. Cl.[6] ..... G10L 5/02

[52] U.S. Cl. ..... 704/260; 704/258

[58] Field of Search ..... 704/258, 259, 704/267, 268, 260

[56] References Cited

U.S. PATENT DOCUMENTS

| | | | |
|---|---|---|---|
| 3,704,345 | 11/1972 | Coker et al. | 704/266 |
| 4,473,904 | 9/1984 | Suehiro et al. | 381/36 |
| 4,692,941 | 9/1987 | Jacks et al. | 381/52 |
| 4,896,359 | 1/1990 | Yamamoto et al. | 381/52 |
| 5,204,905 | 4/1993 | Mitome . | |
| 5,230,037 | 7/1993 | Giustiniani et al. | 395/2 |
| 5,278,943 | 1/1994 | Gasper et al. . | |
| 5,384,893 | 1/1995 | Hutchins | 395/2.76 |
| 5,636,325 | 6/1997 | Farrett | 395/2.67 |
| 5,652,828 | 7/1997 | Silverman | 395/260 |
| 5,682,501 | 10/1997 | Sharman | 395/2.69 |
| 5,732,395 | 3/1998 | Silverman | 704/260 |
| 5,751,906 | 5/1998 | Silverman | 704/260 |
| 5,781,886 | 7/1998 | Tsujiuchi | 704/275 |

FOREIGN PATENT DOCUMENTS

| | | |
|---|---|---|
| 0 140 777 | 5/1985 | European Pat. Off. . |
| 0 689 192 | 12/1995 | European Pat. Off. . |

OTHER PUBLICATIONS

"Techniques for Modifying Prosodic Information in a Text–to–Speech System," *IBM Technical Disclosure Bulletin,* vol. 38, No. 01, Jan. 1995, p. 527.

*Primary Examiner*—David R. Hudspeth
*Assistant Examiner*—Michael N. Opsasnick
*Attorney, Agent, or Firm*—Pollock, Vande Sande & Amernick

[57] ABSTRACT

In a method and apparatus which use actual speech as auxiliary information and synthesize speech by speech synthesis by rule, prosodic information for a phoneme sequence of each word of a word sequence obtained by an analysis of an input text is set by referring to a word dictionary, and a speech waveform sequence is obtained from the phoneme sequence of each word by referring to a speech waveform dictionary. Additional prosodic information is extracted from input actual speech, and at least one of the set prosodic information or at least one of the extracted prosodic information is selected and used to control the speech waveform sequence to create synthesized speech.

20 Claims, 3 Drawing Sheets

SPEECH SYNTHESIS METHOD UTILIZING AUXILIARY INFORMATION, MEDIUM RECORDED THEREON THE METHOD AND APPARATUS UTILIZING THE METHOD

BACKGROUND OF THE INVENTION

The present invention relates to a speech synthesis method utilizing auxiliary information, a recording medium in which steps of the method are recorded and apparatus utilizing the method and, more particularly, to a speech synthesis method and apparatus that create naturally sounding synthesized speech by additionally using, as auxiliary information, actual human speech information as well as text information.

With a text speech synthesis scheme that synthesizes speech from texts, speech messages can be created with comparative ease and at low cost. However, speech synthesized by this scheme does not have sufficient quality and is far apart from speech actually uttered by human beings. That is, parameters necessary for text speech synthesis in the prior art are all estimated by rules of speech synthesis based on the results of text analysis. On this account, unnatural speech may sometimes be synthesized due to an error in the text analysis or imperfection in the rules of speech synthesis. Furthermore, human speech fluctuates so much in the course of utterance that it is said human beings cannot read twice the same sentence in exactly the same speech sounds. In contrast to this, speech synthesis by rule has a defect that speech messages are monotonous because the rules therefor are mere modeling of average features of human speech. It is mainly for the two reasons given above that the intonation of speech by speech synthesis by rule at present is criticized as unnatural. If these problems can be fixed, the speech synthesis by text will become an effective method for creating speech messages.

On the other hand, in the case of generating speech messages by direct utterance of a human being, it is necessary to hire an expert narrator and prepare a studio or similar favorable environment for recording. During recording, however, even an expert narrator often makes wrong or indistinct utterances and must try again and again; hence, recording consumes an enormous amount of time. Moreover, the speed of utterance must be kept constant and care should be taken of the speech quality that varies with the physical condition of the narrator. Thus, the creation of speech messages costs a lot of money and requires much time.

There is a strong demand in a variety of fields for services of repeatedly offering the same speech messages recorded by an expert narrator in association with an image or picture, if any, just like audio guide messages that are commonly provided or furnished in an exhibition hall or room. Needless to say, the recorded speech messages must be clear and standard in this instance. And when a display screen is used, it is necessary to establish synchronization between the speech messages and pictures or images provided on the display screen. To meet such requirements, it is customary in the art to record speech of an expert narrator reading a text. The recording is repeated until clear, accurate speech is obtained with required quality; hence, it is time-consuming and costly.

Incidentally, when the speech data thus obtained needs to be partly changed after several months or years, it is to be wished that the part of the existing speech messages that is to be changed have the same features (tone quality, pitch, intonation, speed, etc.) as those of the other parts. Hence, it is preferable to have the same narrator record the changed or re-edited speech messages. However, it is not always possible to get cooperation from the original narrator, and if he or she cooperates, it is difficult for him or her to narrate with the same features as in the previous recording. Therefore, it would be very advantageous if it were possible to extract speech features of the narrator and use them to synthesize speech following a desired text or speech sounds of some other person with reproducible features at arbitrary timing.

Alternatively, recording of speech in an animation requires speech of a different feature for each character and animation actors or actresses of the same number as the characters involved record their voice parts in a studio for a long time. If it were possible to synthesize speech from a text through utilization of speech feature information extracted from speech of ordinary people having characteristic voices, animation production costs could be cut.

SUMMARY OF THE INVENTION

It is therefore an object of the present invention to provide a speech synthesis method that permits free modification of features of text synthesized speech by rule, a recording medium on which a procedure by the method is recorded, and an apparatus for carrying out the method.

The speech synthesis method according to the present invention comprises the steps of:

(a) analyzing an input text by reference to a word dictionary and identifying a sequence of words in the input text to obtain a sequence of phonemes of each word;

(b) setting prosodic information on the phonemes in each word;

(c) selecting from a speech waveform dictionary phoneme waveforms corresponding to the phonemes in each word to thereby generate a sequence of phoneme waveforms;

(d) extracting prosodic information from input actual speech;

(e) selecting at least one part of the extracted prosodic information or at least one part of the set prosodic information; and (f) generating synthesized speech by controlling the sequence of phoneme waveforms with the selected prosodic information.

The recording medium according to the present invention has recorded thereon the above method as a procedure.

The speech synthesizer according to the present invention comprises:

text analysis means for sequentially identifying a sequence of words forming an input text by reference to a word dictionary to thereby obtain a sequence of phonemes of each word;

prosodic information setting means for setting prosodic information on each phoneme in each word that is set in the word dictionary in association with the word;

speech segment select means for selectively reading out of a speech waveform dictionary a speech waveform corresponding to each phoneme in each identified word;

prosodic information extract means for extracting prosodic information from input actual speech;

prosodic information select means for selecting either at least one part of the set prosodic information or at least one part of the extracted prosodic information; and speech synthesizing means for controlling the selected speech waveform by the selected prosodic information and outputting synthesized speech.

DESCRIPTION OF THE PREFERRED EMBODIMENTS

Figure 1:
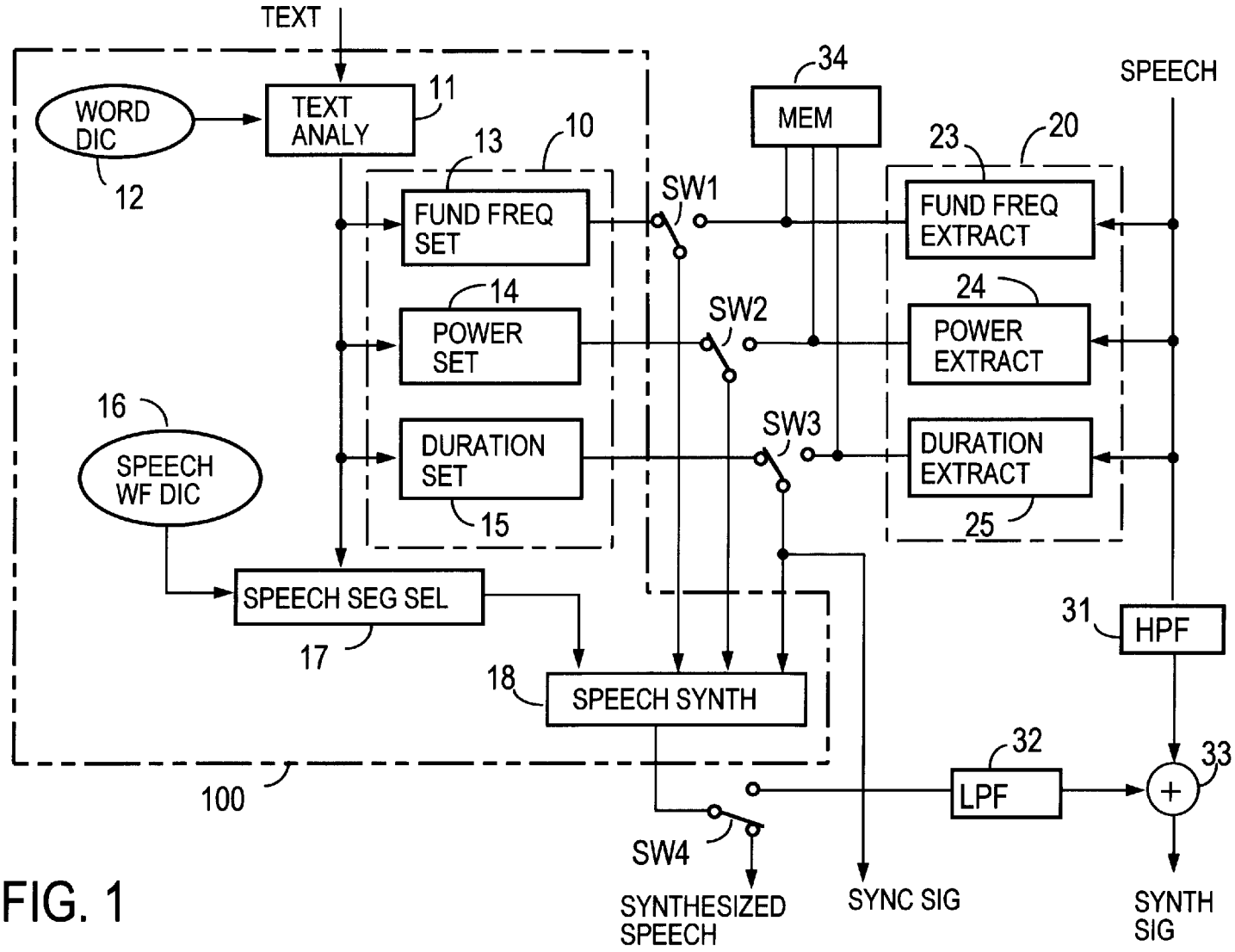
FIG. 1 is a block diagram illustrating an embodiment of the present invention.

Referring first to FIG. 1, an embodiment of the present invention will be described. FIG. 1 is a diagram for explaining a flow of operations of synthesizing speech based on a text and speech uttered by reading the text.

A description will be given first of the input of text information.

Reference numeral 100 denotes a speech synthesizer for synthesizing speech by the conventional speech synthesis by rule, which is composed of a text analysis part 11, a word dictionary 12, a prosodic information setting part 10, a speech waveform dictionary 16, a speech segment select part 17, and a speech synthesis part 18. The text analysis part 11 analyzes a character string of a sentence input as text information via a word processor or similar input device and outputs the results of analysis. In the word dictionary 12 there are stored pronunciations, accent types and parts of speech of words. The text analysis part 11 first detects punctuation marks in the character string of the input text information and divides it according to the punctuation marks into plural character strings. And the text analysis part 11 performs the following processing for each character string. That is, characters are sequentially separated from the beginning of each character string, the thus separated character strings are each matched with words stored in the word dictionary 12, and the character strings found to match the stored words are registered as candidates for words of higher priority in the order of length. Next, part-of-speech information of each candidate word and part-of-speech information of the immediately preceding word already determined are used to calculate ease of concatenation of the words. Finally, a plausible word is provided as the results of analysis taking into account the calculated value and the length of the candidate word. This processing is repeated for each character of the character string from the beginning to the end thereof to iteratively analyze and identify words and, by referring to the word dictionary 12, the reading and accent type of the character string are determined. Since the reading of the character string is thus determined, the number of phonemes forming the word can be obtained. The text analysis part 11 thus analyzes the text and outputs, as the results of analysis, the word boundary in the character string, the pronunciation or reading, accent and part of speech of the word and the number of phonemes forming the word.

The prosodic information setting part 10 is composed of a fundamental frequency setting part 13, a speech power setting part 14 and a duration setting part 15. The fundamental frequency setting part 13 determines the fundamental frequency of each word through utilization of the accent type and length of the word contained in the output from the text analysis part 11. Several methods can be used to determined the fundamental frequency and one of them will be described below. The fundamental frequency setting process is to determine the fundamental frequency according to sex and age and to provide intonations for synthesized speech. The accents or stresses of words are generally attributable to the magnitude of power in English and the level of the fundamental frequency in Japanese. Hence, the fundamental frequency setting process involves processing of setting accents inherent to words and processing of setting the relationship of words in terms of accent magnitude. A method of putting a stress is described in detail in Jonathan Allen et al, "From text to speech," Cambridge University Press, for instance.

The accent type of word, which is output from the text analysis part 11, is a simplified representation of the accent inherent to the word; in the case of Japanese, the accent type is represented by two values "high" (hereinafter expressed by "H") and "low" (hereinafter expressed by "L"). For example, a Japanese word /hashi/, which means a "bridge," has an accent type "LH," whereas a Japanese word /hashi/, which is an english equivalent for "chopsticks" has an accent type "HL." The "H" and "L" refer to the levels of the fundamental frequencies of the vowels /a/ and /i/ in the syllable /hashi/. For example, by setting 100 Hz for "L" and 150 Hz for "H," the value of the fundamental frequency of each vowel is determined. The difference in fundamental frequency between "H" and "L" is 50 Hz and this difference is called the magnitude of accent.

In this way, the fundamental frequency setting part 13 further sets the relationship of respective words in terms of the magnitude of accent. For example, the magnitude of accent of a word formed by many phonemes is set larger than in the case of a word formed by a smaller number of phonemes. When an adjective modifies a noun, the magnitude of the accent of the adjective is set large and the magnitude of the accent of the noun is small. The above-mentioned values 100 and 150 Hz and the rules for setting the magnitude of accents of words relative to each other are predetermined taking into account speech uttered by human beings. In this way, the fundamental frequency of each vowel is determined. Incidentally, each vowel, observed as a physical phenomenon, is a signal that a waveform of a fundamental frequency repeats at intervals of 20 to 30 msec. When such vowels are uttered one after another and one vowel changes to an adjacent vowel of a different fundamental frequency, the fundamental frequencies of the adjacent vowels are interpolated with a straight line so as to smooth the change of the fundamental frequency between the adjacent vowels. The fundamental frequency is set by the processing described above.

The speech power setting part 14 sets the power of speech to be synthesized for each phoneme. In the setting of the power of speech, the value inherent in each phoneme is the most important value. Hence, speech uttered by people asked to read a large number of texts is used to calculate intrinsic power for each phoneme and the calculated values are stored as a table. The power value is set by referring to the table.

The duration setting part 15 sets the duration of each phoneme. The phoneme duration is inherent in each phoneme but it is affected by the phonemes before and after it. Then, all combinations of every phoneme with others are generated and are uttered by people to measure the duration of each phoneme, and the measured values are stored as a table. The phoneme duration is set by referring to the table.

In the speech waveform dictionary 16 there are stored standard speech waveforms of phonemes in the language used, uttered by human beings. The speech waveforms are each added with a symbol indicating the kind of the phoneme, a symbol indicating the start and end points of the phoneme and a symbol indicating its fundamental frequency. These pieces of information are provided in advance.

The speech segment select part 17, which is supplied with the reading or pronunciation of each word from the text analysis part 11, converts the word into a sequence of phonemes forming it and reads out of the speech waveform dictionary 16 the waveform corresponding to each phoneme and information associated therewith.

The speech synthesis part 18 synthesizes speech by processing phoneme waveforms corresponding to a sequence of phonemes selected by the speech segment select part 17 from the speech waveform dictionary 16 on the basis of the fundamental frequency Fo, the power Pw and the phoneme duration Dr set by the respective setting parts 13, 14 and 15.

The above-described speech synthesis method is called speech synthesis by rule, which is well-known in the art. The parameters that controls the speech waveform, such as the fundamental frequency Fo, the power Pw and the phoneme duration Dr, are called prosodic information. In contrast thereto, the phoneme waveforms stored in the dictionary 16 are called phonetic information.

In the FIG. 1 embodiment of the present invention, there are provided an auxiliary information extract part 20 composed of a fundamental frequency extract part 23, a speech power extract part 24 and a phoneme duration extract part 25, and switches SW1, SW2 and SW3 so as to selectively utilize, as auxiliary information, one part or the whole of prosodic information extracted from actual human speech.

Next, a description will be given of the input of speech information on the actual human speech that is auxiliary information.

The fundamental frequency extract part 23 extracts the fundamental frequency of a speech signal waveform generated by human utterance of a text. The fundamental frequency can be extracted by calculating an auto-correlation of the speech waveform at regular time intervals through the use of a window of, for example, a 20 msec length, searching for a maximum value of the auto-correlation over a frequency range of 80 to 300 Hz in which the fundamental frequency is usually present, and calculating a reciprocal of a time delay that provides the maximum value.

The speech power extract part 24 calculates the speech power of the input speech signal waveform. The speech power can be obtained by setting a fixed window length of 20 msec or so and calculating the sum of squares of the speech waveforms in this window.

The phoneme duration extract part 25 measures the duration of each phoneme in the input speech signal waveform. The phoneme duration can be obtained from the phoneme start and end points preset on the basis of observed speech waveform and speech spectrum information.

In the synthesizing of speech by the speech synthesis part 18, either one of the fundamental frequencies from the fundamental frequency setting part 13 and the fundamental frequency extract part 23 is selected via the fundamental frequency select switch SW1. The speech power is also selected via the speech power select switch SW2 from either the speech power setting part 14 or the speech power extract part 24. As for the phoneme duration, too, the phoneme duration from either the phoneme duration setting part 15 or the phoneme duration extract part 25 is selected via the phoneme duration select switch SW3.

In the first place, the speech synthesis part 18 calculates a basic cycle, which is a reciprocal of the fundamental frequency, from the fundamental frequency information accompanying the phoneme waveform selected by the speech segment select part 17 from the speech waveform dictionary 16 in correspondence with each phoneme and separates waveform segments from the phoneme waveform using a window length twice the basic cycle. Next, the basic cycle is calculated from the value of the fundamental frequency set by the fundamental frequency setting part 13 or extracted by the fundamental frequency extract part 23, and the waveform segments are repeatedly connected with each cycle. The connection of the waveform segments is repeated until the total length of the connected waveform reaches the phoneme duration set by the duration setting part 15 or extracted by the duration extract part 25. The connected waveform is multiplied by a constant so that the power of the connected waveform agrees with the value set by the speech power setting part 14 or extracted by the speech power extract part 24. The more the output values from the fundamental frequency extract part 23, the speech power extract part 24 and the duration extract part 25 which are prosodic information extracted from actual human speech is used, the more natural the synthesized speech becomes. These values are suitably selected in accordance with the quality of synthesized speech, the amounts of parameters stored and other conditions.

In the embodiment of FIG. 1, the synthesized speech that is provided from the speech synthesis part 18 is not only output intact via an output speech change-over switch SW4 but it may also be mixed in a combining circuit 33 with input speech filtered by an input speech filter 31 after being filtered by a synthesized speech filter 32. By this, it is possible to output synthesized speech that differs from the speech stored in the speech waveform dictionary 16 as well as the input speech. In this instance, the input speech filter 31 is formed by a high-pass filter of a frequency band sufficiently higher than the fundamental frequency and the synthesized speech filter 32 by a low-pass filter covering a frequency band lower than that of the high-pass filter 31 and containing the fundamental frequency.

By directly outputting, as a synchronizing signal, via the switch SW3 the phoneme duration and the phoneme start and end points set by the duration setting part 15 or extracted by the duration extract part 25, it can be used to provide synchronization between the speech synthesizer and an animation synthesizer or the like. That is, it is possible to establish synchronization between speech messages and lip movements of an animation while referring to the start and end points of each phoneme. For example, while /a/ is uttered, the mouth of the animation is opened wide and in the case of synthesizing /ma/, the mouth is closed during /m/ and is wide open when /a/ is uttered.

The prosodic information extracted by the prosodic information extract part 20 may also be stored in a memory 34 so that it is read out therefrom for an arbitrary input text at an arbitrary time and used to synthesize speech in the speech synthesis part 18. To synthesize speech through the use of prosodic information of actual speech for an arbitrary input text in FIG. 1, prosodic information of actual speech is precalculated about all prosodic patterns that are predicted to be used. As such a prosodic information pattern, it is possible to use an accent pattern that is represented by a term "large" (hereinafter expressed by "L") or "small" (hereinafter expressed by "S") that indicates the magnitude of the afore-mentioned power. For example, words such as /ba/, /hat/ and /good/ have the same accent pattern "L." Such words as /fe/de/ral/, ge/ne/ral/ and te/le/phone/ have the same pattern "LSS." And such words as /con/fuse/ /dis/charge/ and /sus/pend/ have the same pattern "SL."

One word that represents each accent pattern is uttered or pronounced and input as actual speech, from which the prosodic information parameters Fo, Pw and Dr are calculated at regular time intervals. The prosodic information parameters are stored in the memory 34 in association with the representative accent pattern. Sets of such prosodic information parameters obtained from different speakers may be stored in the memory 34 so that the prosodic information corresponding to the accent pattern of each word in the input text is read out of the sets of prosodic information parameters of a desired speaker and used to synthesize speech.

To synthesize speech that follows the input text by using the prosodic information stored in the memory 34, a sequence of words of the input text are identified in the text analysis part 11 by referring to the word dictionary 12 and the accent patterns of the words recorded in the dictionary 12 in association with them are read out therefrom. The prosodic information parameters stored in the memory 34 are read out in correspondence with the accent patterns and are provided to the speech synthesis part 18. On the other hand, the sequence of phonemes detected in the text analysis part 11 is provided to the speech segment select part 17, wherein the corresponding phoneme waveforms are read out of the speech waveform dictionary 16, from which they are provided to the speech synthesis part 18. These phoneme waveforms are controlled using the prosodic information parameters Fo, Pw and Dr read out of the memory 34 as referred to previously and, as a result, synthesized speech is created.

The FIG. 1 embodiment of the speech synthesizer according to the present invention has three usage patterns. A first usage pattern is to synthesize speech of the text input into the text analysis part 11. In this case, the prosodic information parameters Fo, Pw and Dr of speech uttered by a speaker who reads the same sentence as the text or a different sentence are extracted in the prosodic information extract part 20 and selectively used as described previously. In a second usage pattern, prosodic information is extracted about words of various accent patterns and stored in the memory 34, from which the prosodic information corresponding to the accent pattern of each word in the input text is read out and selectively used to synthesize speech. In a third usage pattern, the low-frequency band of the synthesized speech and a different frequency band extracted from the input actual speech of the same sentence as the text are combined and the resulting synthesized speech is output.

Figure 2:
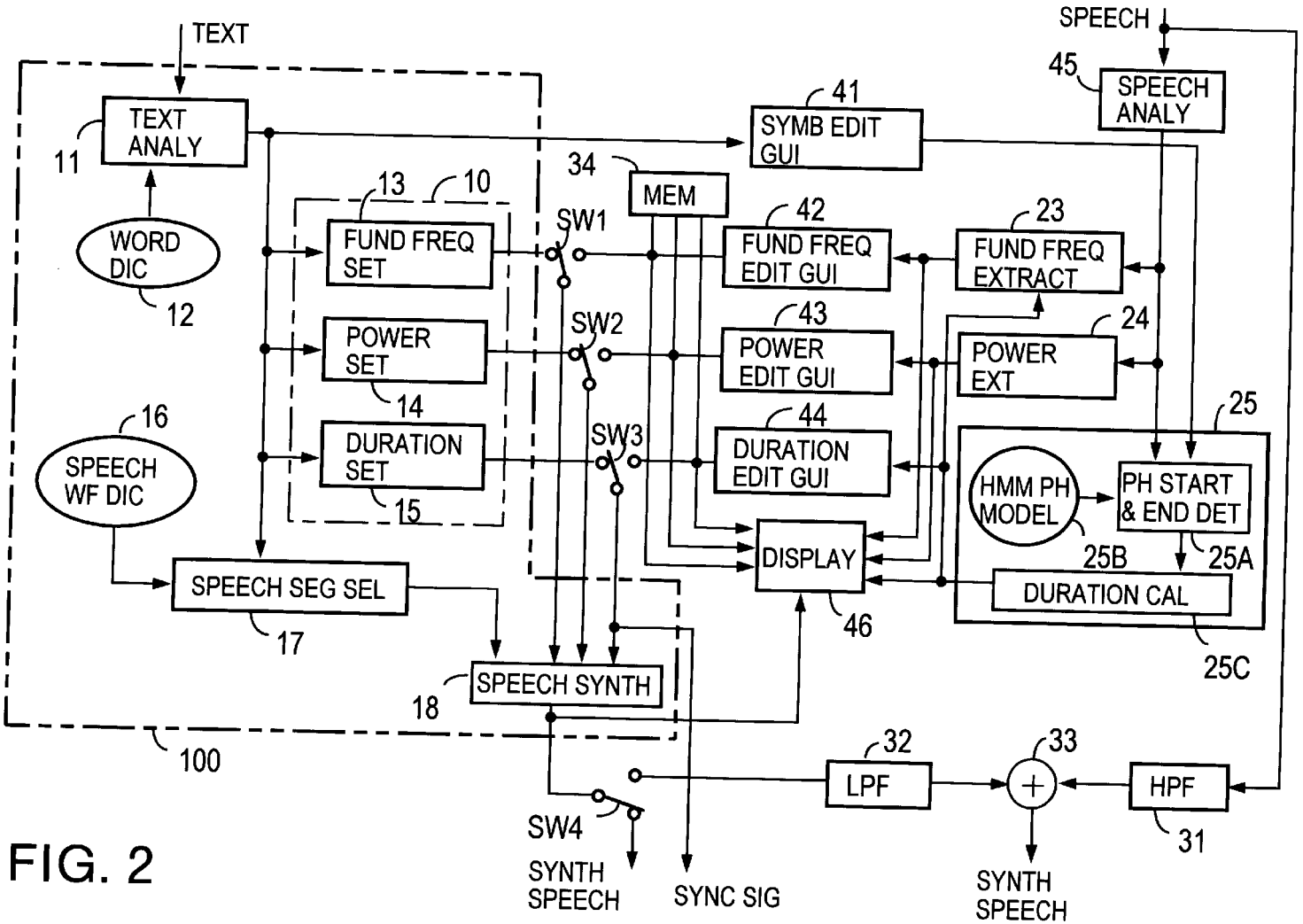
FIG. 2 is a block diagram illustrating another embodiment of the present invention.

In general, errors arise in the extraction of the fundamental frequency Fo in the fundamental frequency extract part 23 and in the extraction of the phoneme duration Dr in the duration extract part 25. Since such extraction errors adversely affect the quality of synthesized speech, it is important to minimize the extraction errors so as to obtain synthesized speech of excellent quality. FIG. 2 illustrates another embodiment of the invention which is intended to solve this problem and has a function of automatically extracting the prosodic information parameters and a function of manually correcting the prosodic information parameters This second embodiment has, in addition to the configuration of FIG. 1, a speech symbol editor 41, a fundamental frequency editor 42, a speech power editor 43, a phoneme duration editor 44, a speech analysis part 45 and a display part 46. The editors 41 through 44 each form a graphical user interface (GUI), which modifies prosodic information parameters displayed on the screen of the display part 46 by the manipulation of a keyboard or mouse.

The phoneme duration extract part 25 comprises a phoneme start and end point determination part 25A, an HMM (Hidden Markov Model) phoneme model dictionary 25B and a duration calculating part 25C. In the HMM phoneme model dictionary 25B there are stored a standard HMM that represents each phoneme by a state transition of a spectrum distribution, for example, a cepstrum distribution. The HMM model structure is described in detail, for example, in S. Takahashi and S. Sugiyama, "Four-level tied structure for efficient representation of acoustic modeling," Proc. ICASSP95, pp.520–523, 1995. The speech analysis part 45 calculates, at regular time intervals, the auto-correlation function of the input speech signal by an analysis window of, for example, a 20 msec length and provides the auto-correlation function to the speech power extract part 24 and, further calculates from the auto-correlation function a speech spectrum feature such as a cepstrum and provides it to the phoneme start and end point determination part 25A. The phoneme start and end point determination part 25A reads out of the HMM phoneme model dictionary 25B HMMs corresponding to respective phonemes of a sequence of modified symbols from the speech symbol editor 41 to obtain an HMM sequence. This HMM sequence is compared with the cepstrum sequence from the speech analysis part 45 and boundaries in the HMM sequence corresponding to phoneme boundaries in the text are calculated and the start and end point of each phoneme are determined. The difference between the start and end points of each phoneme is calculated by the duration calculating part 25C and set as the duration of the phoneme. By this, the period of each phoneme, i.e. the start and end points of the phoneme on the input speech waveform are determined. This is called phoneme labeling.

The fundamental frequency extract part 23 is supplied with the auto-correlation function from the speech analysis part 45 and calculates the fundamental frequency from a reciprocal of a correlation delay time that maximizes the auto-correlation function. An algorithm for extracting the fundamental frequency is disclosed, for example, in L. Rabiner et al, "A comparative performance study of several pitch detection algorithms," IEEE Trans. ASSP, ASSP-24, pp.300–428, 1976. By extracting the fundamental frequency between the start and end points of each phoneme determined by the duration extract part 25, the fundamental frequency of the phoneme in its exact period can be obtained.

The speech power extract part 24 calculates, as the speech power, a zero-order term of the auto-correlation function provided from the speech analysis part 45.

The speech symbol editor (GUI) 41 is supplied with a speech symbol sequence of a word identified by the text analysis part 11 and its accent pattern (for example, the "high" or "low" level of the fundamental frequency Fo) and displays them on the screen of display part 46. By reading the contents of the displayed speech symbol sequence, an identification error by the text analysis part 11 can immediately be detected. This error can be detected from the displayed accent pattern, too.

Figure 3:
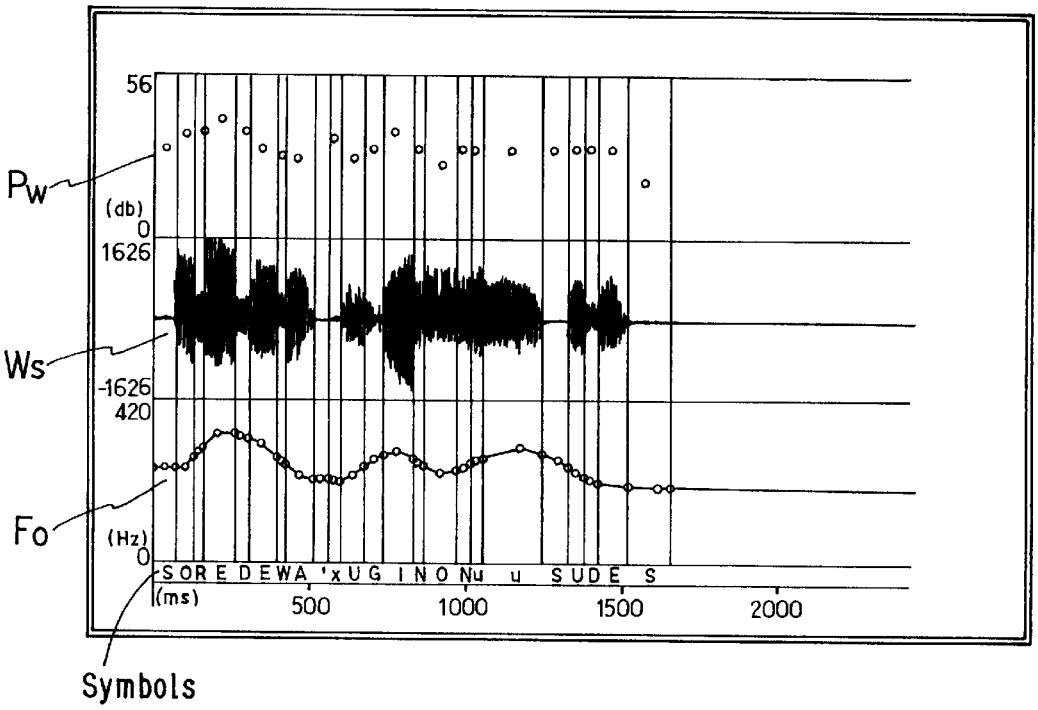
FIG. 3 is a diagram showing an example of a display of prosodic information in the FIG. 2 embodiment.

The GUIs 42, 43 and 44 are prosodic parameter editors, which display on the same display screen the fundamental frequency Fo, the speech power Pw and the duration Dr extracted by the fundamental frequency extract part 23, the speech power extract part 24 and the duration extract part 25 and, at the same time, modify these prosodic parameters on the display screen by the manipulation of a mouse or keyboard. FIG. 3 shows, by way of example, displays of the prosodic parameters Fo. Pw and Dr provided on the same display screen of the display part 46, together with an input text symbol sequence "soredewa/tsugino/nyusudesu" (which means "Here comes the next news") and a synthesized speech waveform Ws. The duration Dr of each phoneme is a period divided by vertical lines indicating the start and end points of the phoneme. By displaying the symbol sequence and the prosodic parameters Fo and Pw in correspondence with each other, an error could be detected at first glance if the period of a consonant, which ought to be shorter than the period of a vowel, is abnormally long. Similarly, an unnatural fundamental frequency and speech power can also be detected by visual inspection. By correcting these errors on the display screen through the keyboard or mouse, the corresponding GUIs modify the parameters.

Figure 4:
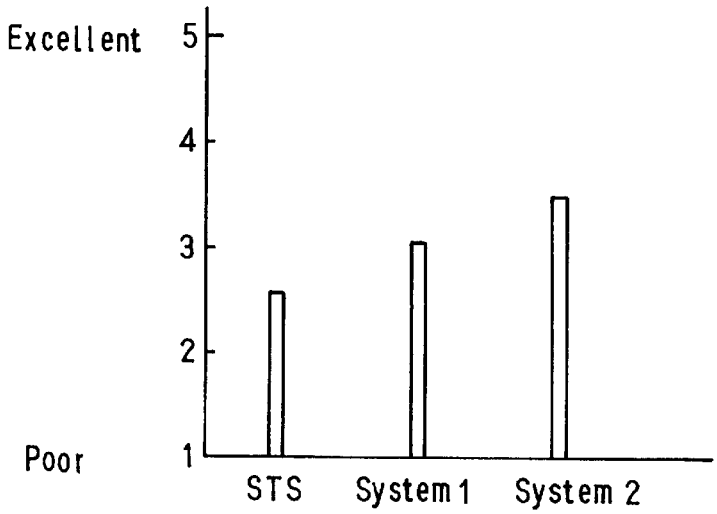
FIG. 4 is a graph for explaining the effect of the FIG. 2 embodiment.

To evaluate the effects of the prosodic parameter editors 42, 43 and 44 in the embodiment of FIG. 2, a listening test was carried out. Listeners listened to synthesized speech and rated its quality on a 1-to-5 scale (1 being poor and 5 excellent). The test results are shown in FIG. 4, in which the ordinate represents the preference score. STS indicates a conventional system of speech synthesis from text, system 1 a system in which text and speech are input and speech is synthesized using prosodic parameters automatically extracted from the input speech, and system 2 a system of synthesizing speech using the afore-mentioned editors. As will be seen from FIG. 4, system 1 does not produce a marked effect of inputting speech as auxiliary information because it contains an error in the automatic extraction of the prosodic parameters. On the other hand, system 2 greatly improves the speech quality. Thus, it is necessary to correct the automatic extraction error and the effectiveness of the editors 42, 43 and 44 as GUIs is evident.

The speech synthesis by the present invention described above with reference to FIGS. 1 and 2 is performed by a computer. That is, the computer processes the input text and input actual speech to synthesize speech, following the procedure of this invention method recorded on a recording medium.

As described above, according to the present invention, it is possible to create high quality, natural sounding synthesized speech unobtainable with the prior art, by utilizing not only a text but also speech uttered by reading it or similar text and extracting and using prosodic information and auxiliary information contained in the speech, such as a speech signal of a desired band.

Of the rules for speech synthesis, prosodic information about the pitch of speech, the phoneme duration and speech power is particularly affected by the situation of utterance and the context and closely related to the emotion and intention of the speech, too. It is possible, therefore, to effect control that creates speech messages rich in expression, by controlling the speech synthesis by rule through utilization of such prosodic information of the actual speech. In contrast to this, the prosodic information obtained from input text information alone is predetermined; hence, synthesized speech sounds monotonous. By effectively using speech uttered by human beings or information about its one part, the text-synthesized speech can be made to resemble the human speech. In the case of synthesizing speech of a text A through the use of prosodic information of human speech, the text A need not always be read by a human being. That is, the prosodic information that is used to synthesize speech of the text A can be extracted from actual speech uttered by reading a different text. This permits generation of limitless combinations of prosodic information parameters from limited prosodic information parameters.

Furthermore, by extracting as auxiliary information a signal of some frequency band from human speech and adding it with speech synthesized by rules, it is possible to create synthesized speech similar to speech of a particular person. The conventional speech synthesizing methods can synthesize speech of several kinds of different speakers, and hence are limited in applications, but the present invention broadens the applications of the speech synthesis techniques.

Moreover, the above-described embodiments of the present invention permit synchronization between the speech synthesizer and an image generator by outputting, as a synchronizing signal, the duration Dr set or extracted for each phoneme. Now, consider the case of letting a character of an animation to talk. In the production of an animation, it is important to provide temporal synchronization between lip movements and speech signals; much labor is needed to maintain synchronization for moving the animation in unison with speech or for a person to speak in unison with the animation. On the other hand, in speech synthesis by rule the kind of each phoneme and its start and end points can clearly be designated. Hence, by outputting these pieces of information as auxiliary information and using it to determine movements of the animation, synchronization can easily be provided between lip movements and speech signals.

EFFECT OF THE INVENTION

As described above, the present invention produces mainly such effects as listed below.

Through utilization of auxiliary information about prosodic parameters extracted from natural speech, it is possible to synthesize highly natural speech unobtainable with the prior art. And, since some particular band information of natural speech can be used, various kinds of speech can be synthesized.

The conventional speech synthesis by rule synthesizes speech from only texts, but the present invention utilizes all or some pieces of auxiliary information obtainable from actual speech, and hence it permits creation of synthesized speech messages of enhanced quality of various levels according to the degree of use (or kinds) of the auxiliary information.

Besides, since text information and speech information are held in correspondence with each other, the phoneme duration and other information can be controlled or output—this allows ease in providing synchronization between moving pictures of the face and other parts of an animation.

It will be apparent that many modifications and variations may be effected without departing from the scope of the novel concepts of the present invention.

What is claimed is:

1. A text speech synthesis method by rule which synthesizes arbitrary speech through the use of an input text, said method comprising the steps of:

(a) analyzing said input text by reference to a word dictionary and identifying a sequence of words in said input text to obtain a sequence of phonemes of each word;

(b) setting a fundamental frequency, a power and a phoneme duration specified for each phoneme of said each word as first prosodic parameters on the basis of said word dictionary;

(c) selecting from a speech waveform dictionary phoneme waveforms corresponding to said phonemes in said each word to thereby generate a sequence of phoneme waveforms;

(d) extracting a fundamental frequency, a speech power and a phoneme duration as second prosodic parameters from input actual speech;

(e) selecting at least one of said first prosodic parameters or at least one of said second prosodic parameters as a selected prosodic parameter; and (f) generating synthesized speech by controlling said sequence of phoneme waveforms with said selected prosodic parameter.

2. The method of claim 1, wherein said step (e) includes a step of selecting at least one of said second prosodic parameters and said first prosodic parameters corresponding to the remaining second prosodic parameters other than said at least one of said second prosodic parameters.

3. The method of claim 1, further comprising a step of extracting a desired band of said input actual speech and mixing it with another band of said synthesized speech to create synthesized speech for output.

4. The method of claim 1 or claim 2, wherein said phoneme duration in said selected prosodic parameters, which represents start and end points of said each phoneme, is output as a speech synchronizing signal to be used externally.

5. The method of claim 1 or claim 2, wherein a sentence of said actual speech and a sentence of said text are the same.

6. The method of claim 1 or 2, wherein a sentence of said actual speech and a sentence of said text differ from each other.

7. The method of claim 1, wherein said step (d) includes a step of storing said second prosodic parameters in a memory and said step (e) includes a step of reading out at least one part of said second prosodic parameters from said memory.

8. The method of claim 1, further comprising a step of displaying at least one of said extracted fundamental frequency, speech power and phoneme duration on a display screen and correcting an extraction error.

9. A speech synthesizer for synthesizing speech corresponding to input text by speech synthesis by rule, said synthesizer comprising:

text analysis means for sequentially identifying a sequence of words forming said input text by reference to a word dictionary to thereby obtain a sequence of phonemes of each word;

prosodic parameter setting means for setting first prosodic parameters for each phoneme in said each word that is set in said word dictionary in association with said each word, said prosodic parameter setting means including fundamental frequency setting means, speech power setting means and duration setting means for setting, respectively, a fundamental frequency, speech power and duration of each phoneme as said first prosodic parameters for said each word provided in said word dictionary in association with said each word;

speech segment select means for selectively reading out of a speech waveform dictionary a speech waveform corresponding to said each phoneme in each of said identified words;

prosodic parameter extracting means for extracting second prosodic parameters from input actual speech, said prosdic parameter extracting means including fundamental frequency extracting means, speech power extracting means and duration extracting means for extracting, respectively, a fundamental frequency, a speech power and a phoneme duration as said second prosodic parameters from said input actual speech through a fixed analysis window at a regular time interval;

prosodic parameter select means for selecting at least one of said first prosodic parameters or at least one of said second prosodic parameters as a selected prosodic parameter; and speech synthesizing means for controlling said selected speech waveform by said selected prosodic parameters and for outputting said synthesized speech.

10. The synthesizer of claim 9, wherein either one of said phoneme duration in said first and second prosodic parameters is output as a synchronizing signal to be used externally.

11. The synthesizer of claim 9, which further comprises memory means for storing said second prosodic parameters and wherein said select means reads out at least one part of said second prosodic parameters from said memory means.

12. The synthesizer of claim 9, further comprising first filter means for passing therethrough a predetermined first band of said input actual speech, second filter means for passing therethrough a second band of synthesized speech from said speech synthesizing means that differs from said first band, and combining means for combining the outputs from said first and second filter means into synthesized speech for output.

13. The synthesizer of claim 12, wherein said first filter means is a high-pass filter for passing a band higher than said fundamental frequency and said second filter means is a low-pass filter for passing a band containing said fundamental frequency and frequencies lower than the band of said first filter means.

14. The synthesizer of claim 9, further comprising display means for displaying said second prosodic parameters and a prosodic information graphical user interface for modifying said second prosodic parameters by correcting an error of said second prosodic parameters displayed on the display screen.

15. The synthesizer of claim 14, wherein said prosodic information graphical user interface includes fundamental frequency editor means for modifying said extracted fundamental frequency in response to a correction of said displayed fundamental frequency, speech power editor means for modifying said extracted speech power in response to a correction of said displayed speech power, and phoneme duration editor means for modifying said extracted phoneme duration in response to a correction of said displayed phoneme duration.

16. The synthesizer of claim 15, wherein said display means includes speech editor means for displaying a speech symbol sequence provided from said text analysis means and for correcting an error in a speech symbol sequence displayed by said display means to thereby correct the corresponding error in said speech symbol sequence.

17. A recording medium which has recorded thereon a procedure for synthesizing arbitrary speech by rule from an input text, said procedure comprising the steps of:

(a) analyzing said input text by reference to a word dictionary and identifying a sequence of words in said input text to obtain a sequence of phonemes of each word;

(b) setting first prosodic parameters for each of said phonemes in said each word;

(c) selecting from a speech waveform dictionary phoneme waveforms corresponding to said phonemes in said each word to thereby generate a sequence of phoneme waveforms;

(d) extracting a fundamental frequency, a speech power and a phoneme duration from input actual speech as second prosodic parameters;

(e) selecting at least one of said first prosodic parameters or at least one of said second prosodic parameters as a selected prosodic parameter; and (f) generating synthesized speech by controlling said sequence of phoneme waveforms with said selected prosodic parameters.

18. The recording medium of claim 17, wherein said procedure further comprises a step of extracting a desired band of said input actual speech and mixing it with another band of said synthesized speech to create synthesized speech for output.

19. The recording medium of claim 17, wherein said step (d) includes a step of storing said second prosodic parameters in a memory and said step (e) includes a step of reading out at least one of said second prosodic parameters from said memory.

20. The recording medium of claim 17, wherein said procedure includes a step of displaying at least one of said extracted fundamental frequency, speech power and phoneme duration on a display screen and correcting an extraction error.

* * * * *